United States Patent [19]

Mukai et al.

[11] 4,271,387

[45] Jun. 2, 1981

[54] METHOD AND SYSTEM OF CONTROLLING EFFECTIVE VALUE OF ALTERNATING CURRENT

[75] Inventors: Kuniaki Mukai, Hachioji; Kouichi Hyodo, Chofu, both of Japan

[73] Assignee: Tokyo Shibaura Denki Kabushiki Kaisha, Kanagawa, Japan

[21] Appl. No.: 29,938

[22] Filed: Apr. 13, 1979

[30] Foreign Application Priority Data

Apr. 20, 1978 [JP] Japan ..... 53-47078
Apr. 25, 1978 [JP] Japan ..... 53-48977

[51] Int. Cl.[3] ..... G05F 1/455
[52] U.S. Cl. ..... 323/241; 323/246
[58] Field of Search ..... 323/24, 34, 119

[56] References Cited

U.S. PATENT DOCUMENTS

| | | | |
|---|---|---|---|
| 4,000,455 | 12/1976 | Gyueyi et al. | 323/119 |
| 4,147,910 | 4/1979 | Kiuchi et al. | 323/24 X |
| 4,158,164 | 6/1979 | Nutz | 323/24 |

*Primary Examiner*—A. D. Pellinen

*Attorney, Agent, or Firm*—Stevens, Davis, Miller & Mosher

[57] ABSTRACT

In a method and system of controlling the effective value of alternating current supplied to a load through controlled semiconductor switching elements which are connected in parallel opposition, circuits are provided to produce data $$\frac{\Delta I/\Delta\alpha}{I_{90}}$$

where ΔI represents an increment of the load current, Δα an increment of the ignition angle α and $I_{90}$ the effective value of the load current at an ignition angle of 90°. Δα is calculated according to an equation $$\Delta\alpha = \frac{\text{current deviation} \times K}{I_{90} \times (\Delta I/\Delta\alpha)/I_{90}}$$

where K is a constant smaller than 1. Then Δα is added to an ignition angle $\alpha_1$ in a preceding half cycle to determine a new ignition angle which is used to control the controlled semiconductor switching elements.

5 Claims, 5 Drawing Figures

METHOD AND SYSTEM OF CONTROLLING EFFECTIVE VALUE OF ALTERNATING CURRENT

BACKGROUND OF THE INVENTION

This invention relates to a method and system of controlling the effective value of alternating current to a preset value.

In an alternating current system wherein alternating current is supplied to an AC load through a pair of controlled semiconductor switching elements, for example thyristors, which are connected in parallel opposition, it is desirable to maintain the effective value of the alternating current at a prescribed set value and to change the set value when desired. However, as will be described later in more detail according to a prior art method and system where the power factor of the load varies greatly it has been difficult to increase the response speed of the system and to improve the stability thereof.

SUMMARY OF THE INVENTION

It is an object of this invention to provide an improved method and system of controlling the effective value of alternating current which can obviate the difficulties described above.

According to one aspect of this invention there is provided a method of controlling the effective value of alternating current supplied to a load from a source of alternating current through controlled semiconductor switching elements which are connected in parallel opposition, wherein the effective value of the alternating current is controlled by comparing a reference current with an effective value of the load current actually measured, characterized by the steps of producing a data $$\frac{\Delta I/\Delta\alpha}{I_{90}}$$

where $\Delta I$ represents an increment of the load current, $\Delta\alpha$ an increment of the ignition angle of the controlled semiconductor switching elements and $I_{90}$ the effective value of the load current at an ignition angle of 90°, calculating $\Delta\alpha$ according to an equation $$\Delta\alpha = \frac{\text{current deviation} \times K}{I_{90} \times (\Delta I/\Delta\alpha)/I_{90}}$$

where K is a constant smaller than 1, adding $\Delta\alpha$ to an ignition angle $\alpha_1$ in a preceding half cycle to determine a new ignition angle, and controlling the controlled semiconductor switching elements according to the new ignition angle.

According to another aspect of this invention there is provided a system of controlling the effective value of alternating current supplied to a load from a source of alternating current through controlled semiconductor switching elements which are connected in parallel opposition, the system comprising a reference current setter, means for detecting the effective value of the load current, a deviation detector which detects the difference between the output of the reference current setter and the output of the means for detecting the effective value, and means responsive to the output of the deviation detector for controlling the ignition angle of the controlled semiconductor switching elements, characterized in that there are provided a first memory device which is connected to the output of the effective value detecting means for storing the effective value of the load current $I_{90}$ at an ignition angle of 90°, a second memory device responsive to the power factor $\phi$ of the load or the ignition angle of the switching element for producing data $$\frac{\Delta I/\Delta\alpha}{I_{90}}$$

where $\Delta I$ represents an increment of the load current and $\Delta\alpha$ an increment of the ignition angle $\alpha$, an operational circuit responsive to the outputs of the deviation detector and of the first and second memory circuits for calculating the value of $\Delta\alpha$ according to an equation:

$$\Delta\alpha = \frac{\text{current deviation} \times K}{I_{90} \times (\Delta I/\Delta\alpha)/I_{90}}$$

where K represents a constant smaller than 1, and an adder which adds $\Delta\alpha$ thus calculated to an ignition angle $\Delta_1$ in a preceding half cycle to determine a new ignition angle $\Delta_2$ and is connected to apply the new ignition angle $\Delta_2$ to the ignition angle control means.

DESCRIPTION OF THE PREFERRED EMBODIMENT

Figure 1:
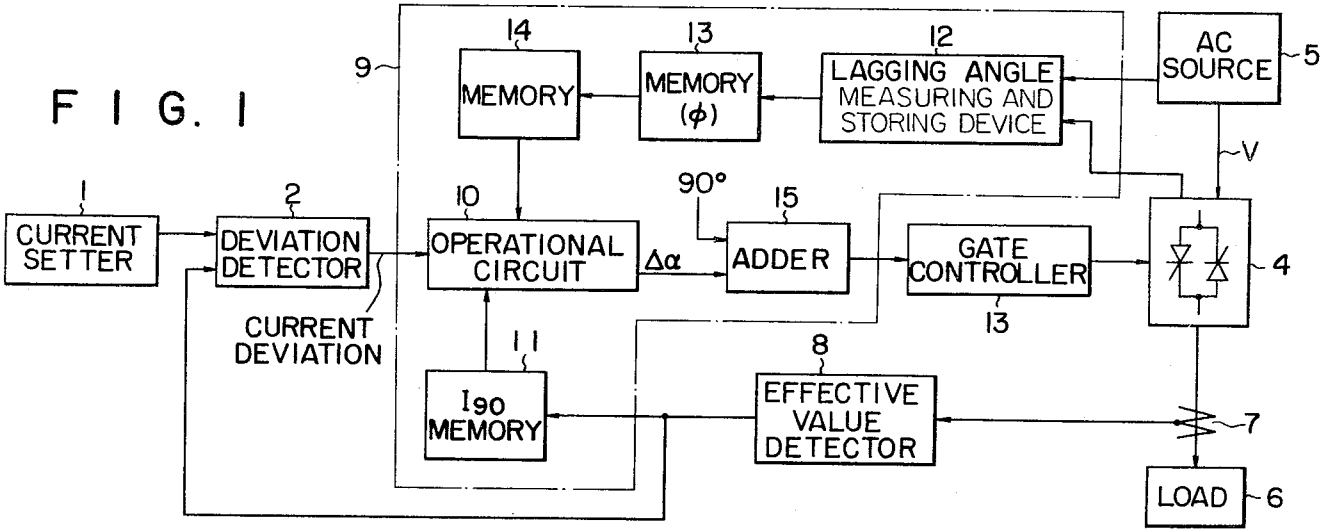
FIG. 1 is a block diagram showing one embodiment of the control system according to this invention.

In FIG. 1 elements bounded by dot and dash lines 9 are added according to this invention to the elements of a prior art system of controlling the effective value of alternating current. Accordingly, for the sake of description elements outside the dot and dash lines 9 will be firstly discussed.

Figure 4:
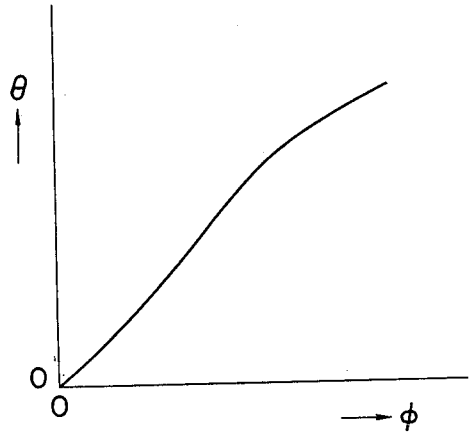
FIG. 4 is a graph showing the relationship between load power factor and current lagging angle.

More particularly, the prior art control system comprises a current setter 1 which produces a voltage proportional to the current value set therein. The current of a source of alternating current 5 is supplied to an AC load 6 through a pair of controlled semiconductor switching elements 4 which are connected in parallel opposition. Since thyristors are generally used as such switching elements, in the following description they are designated as thyristors. The current flowing through the load 6 is detected by a current transformer 7 and its output is applied to an effective value detector 8 which comprises a squaring circuit for obtaining the square of the instantaneous value of the output current of the current transformer 7, an integrating circuit which integrates the squared instantaneous value of the current in synchronism with the source voltage over one half cycle thereof, a circuit for calculating the mean value of the integrated value over one half period of the source voltage, and a circuit calculating a square root of the mean value. Thus, the output of the effective value detector 8 is a voltage proportional to the effective value of the load current. Until one half cycle of the source voltage elapses the effective value cannot be determined so that the output of the detector 8 is maintained at a definite value during one half cycle. The deviation of the output (which is proportional to the load current) of the detector 8 from the value preset in the current setter 1 is detected and amplified by a deviation detector 2. The output of the deviation detector 2 is applied to a gate controller 3 which converts the deviation into the ignition angle of the thyristors thereby producing an ignition pulse having an ignition angle proportional to the output voltage of the deviation detector and synchronous with the source voltage. The term "ignition angle" is used herein to mean an electrical angle ($\alpha_1$ and $\alpha_2$, FIG. 4) between an instant at which an ignition pulse is generated and an instant at which the source voltage passes through zero.

Figure 2:
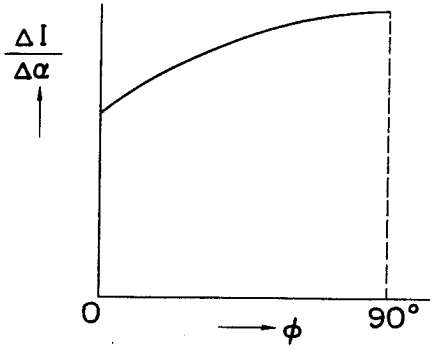
FIG. 2 is a graph showing the relationship between the power factor of the load and the ratio of current increment to the ignition angle increment.

With this prior art system when the current set value is changed, the amount of current variation increases and the ignition angle also varies. However, since the ignition pulse should be synchronous with the source voltage an idle time is inevitable, a maximum of one half cycle of the source voltage. Variation in the ignition angle results in the variation in the load current but before the output of the effective value detector 8, that is the amount of feed back varies actually, it takes one half cycle of the source voltage for the reason described above. Thus, the actual variation in the feed back quantity lags the change in the current set value by a maximum of one cycle of the source voltage. Where the load varies, the ratio of the increment $\Delta I$ of the load current I to the increment $\Delta\alpha$ of the ignition angle $\alpha$, that is $\Delta I/\Delta\alpha$ would not be constant. Even where the magnitude of the load is constant, as the power factor $\phi$ varies, the ratio $\Delta I/\Delta\alpha$ varies as shown in FIG. 2.

In order to operate satisfactorily the control system including inherent delay and gain variation, it is necessary to provide a sufficiently large delay element for the deviation detector or between it and the gate controller 3 so as to gradually vary the ignition angle. Otherwise, hunting occurs causing unstability. Thus, with this system it has been impossible to assure a high response speed.

These defects can be eliminated according to this invention by adding the elements bounded by dot and dash lines 9 to the elements described above.

Figure 3:
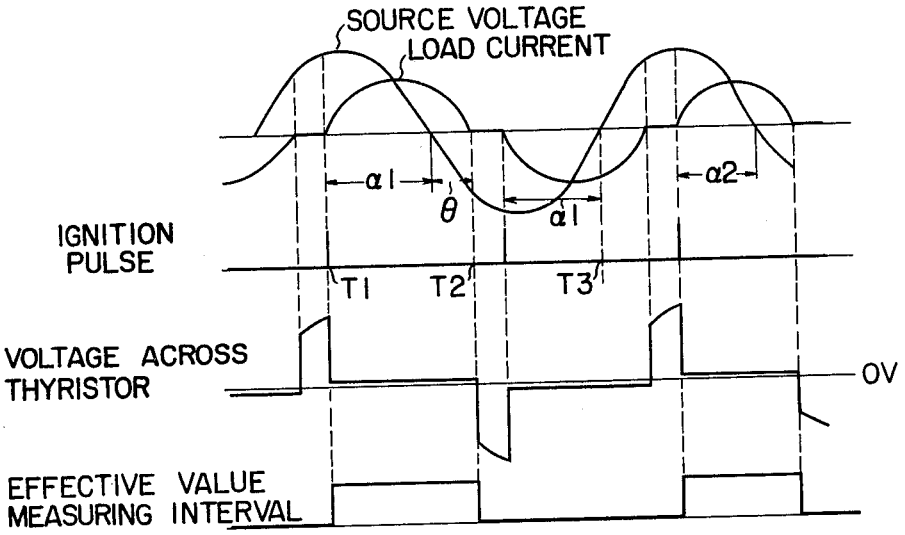
FIG. 3 is a timing chart useful to explain the operation of the system shown in FIG. 1.

In the following description, it is assumed that the outputs of the current setter 1 and the effective value detector 8 are digital quantities. The elements added include a memory device 11 which stores the effective value of current $I_{90}$ at an ignition angle of 90° immediately after starting the load, and a device 12 which measures and stores the current lagging angle $\theta$ at an ignition angle 90° immediately after starting. As shown in FIG. 3, the lagging angle $\theta$ represents an interval between an instant at which the source voltage changes from positive to negative and an instant at which the voltage across a thyristor has increased to the source voltage from the forward saturation voltage.

There is also provided a memory device 13 adapted to store the relationship between the current lagging angle $\theta$ at the ignition angle of 90° and load power factor $\phi$. The memory device 13 receives as an address the value of $\phi$ and in response thereto, produces the content at the address as the value of the power factor $\phi$. The relationship between the current lagging angle $\theta$ and the load power factor $\phi$ is shown by a graph in FIG. 4. The relationship can be obtained by calculation.

A memory device 14 is connected to the output of the memory device 13 to store data $(\Delta I/\Delta\alpha)/I_{90}$ at different load power factor $\phi$. Data $(\Delta I/\Delta\alpha)/I_{90}$ at different power factor $\phi$ are calculated in advance according to FIG. 2, for example, and stored in respective addresses corresponding to various values of the power factor $\phi$ so that when the memory device 14 receives, as an address the power factor $\phi$ it produces the content at the address as the corresponding value of $(\Delta I/\Delta\alpha)/I_{90}$.

An operational circuit 10 is provided which calculates the ignition angle increment $\Delta\alpha$ according to the following equation (1) by utilizing the effective value of current $I_{90}$ at the ignition angle of 90° supplied from the memory device 11, the data $(\Delta I/\Delta\alpha)/I_{90}$ for a specific power factor supplied from the memory device 14 and the output from the deviation detector 2.

$$\Delta\alpha = \frac{\text{current deviation} \times K}{I_{90} \times (\Delta I/\Delta\alpha)/I_{90}} \quad (1)$$

where K represents a gain constant smaller than 1.

To the output of the operational circuit 10 is connected an adder 15 which adds $\Delta\alpha$ to an ignition angle $\alpha_1$ in the preceding cycle to obtain a new ignition angle $\Delta_2$. The output of the adder 15 is applied to the gate controller 3.

During the first one cycle at the start of the load, since the ignition angle $\Delta_1$ in the preceding cycle is not available a digital signal corresponding to 90° ignition angle is produced as the new ignition angle $\Delta_2$.

The operation of the system shown in FIG. 1 will now be described with reference to the timing chart shown in FIG. 3. The instantaneous value of the load current is measured during an interval between $T_1$ at which an ignition pulse is generated to turn ON a thyristor and $T_2$ at which the thyristor turns OFF. The effective value of the current is then determined by the effective value detector and the deviation between the effective value of the current thus determined and the set value is detected by the deviation detector 2 during the interval $T_1$–$T_2$. Then, during the next cycle the new ignition angle $\alpha_2$ is calculated by the operational circuit 10 and adder 15. When the load current becomes zero (thyristor turns OFF), the voltage across the thyristor increases rapidly. The time $T_2$ can be detected from such rapid voltage increase. It is herein assumed that the ignition angle is the same for a positive half cycle and a succeeding negative half cycle of the source voltage.

When the value of current set in the current setter is changed, current deviation is detected by the deviation detector 2 and $\Delta\alpha$ is calculated according to equation (1). The ratio $\Delta I/\Delta\alpha$ under an actual load can be determined by reading out the power factor $\phi$ from the memory device 13 according to the value of the current lagging angle $\theta$ stored in the device 12, reading out data $(\Delta I/\Delta\alpha)/I_{90}$ from the memory device 14 for a specific power factor $\phi$ and then multiplying the data with the current $I_{90}$ actually measured. Accordingly, where $K=1$, $\Delta\alpha$ determined by equation (1) gives the current increment close to a target value in a microsection or time. Increase in $\Delta\alpha$ results in the variation in the gain caused by the variation in the ignition angle thus increasing the deviation from the target value and the degree of unstability. However, by selecting the value of K to a suitable value smaller than 1, these defects can be obviated.

As above described, according to this invention, the gain constant is automatically selected according to the magnitude and power factor of the load so that it is possible to control the effective value of the load current at a high response speed and stability for a load whose power factor varies greatly.

Figure 5:
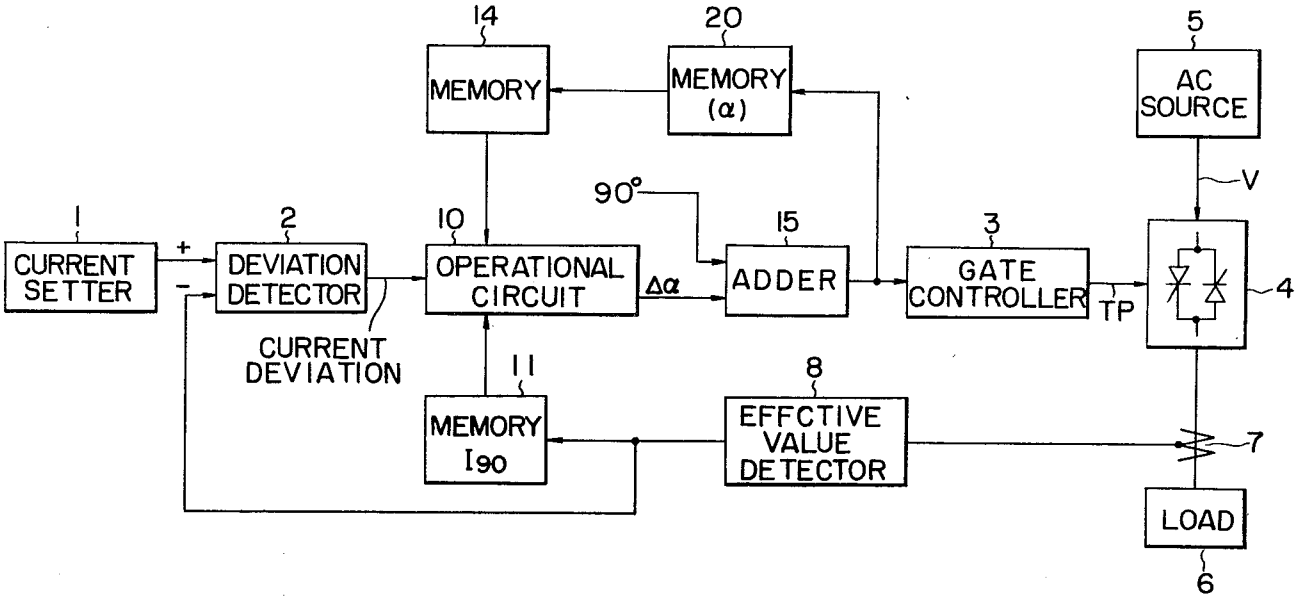
FIG. 5 is a block diagram showing a modified embodiment of this invention.

FIG. 5 shows a modified embodiment of this invention in which elements corresponding to those shown in FIG. 1 are designated by the same reference characters. In this embodiment, the data $(\Delta I/\Delta\alpha)/I_{90}$ calculated in advance for different ignition angle $\alpha$ are stored in respective addresses corresponding to various values of $\alpha$, so that when the memory device 14 receives, as an address, the ignition angle $\alpha$ it produces the content at the address as the corresponding value of $(\Delta I/\Delta\alpha)/I_{90}$. Accordingly, in this embodiment a memory circuit 20 is connected between the output of the adder 15 and the memory device 14 for addressing the same in accordance with the value of $\alpha$. Except this point, the modification shown in FIG. 5 operates in the same manner as that shown in FIG. 1.

What is claimed is:

1. In a method of controlling the effective value of alternating current supplied to a load from a source of alternating current through controlled semiconductor switching elements which are connected in parallel opposition, wherein the effective value of the alternating current is controlled by comparing a reference current with an effective value of the load current actually measured, the improvement which comprises the steps of:

producing data $(\Delta I/\Delta\alpha)/I_{90}$ where $\Delta I$ represents an increment of the load current, $\Delta\alpha$ an increment of the ignition angle $\alpha$ of said controlled semiconductor switching elements and $I_{90}$ the effective value of the load current at an ignition angle of 90°, calculating $\Delta\alpha$ according to an equation $$\Delta\alpha = \frac{\text{current deviation} \times K}{I_{90} \times (\Delta I/\Delta\alpha)/I_{90}}$$

where K is a constant smaller than 1, adding said $\Delta\alpha$ to an ignition angle $\alpha_1$ in a preceding half cycle to determine a new ignition angle, and controlling said controlled semiconductor switching elements according to said new ignition angle.

2. In a system of controlling the effective value of alternating current supplied to a load from a source of alternating current through controlled semiconductor switching elements which are connected in parallel opposition, the system comprising a reference current setter, means for detecting the effective value of the load current, a deviation detector which detects the difference between the output of said reference current setter and the output of said means for detecting the effective value, and means responsive to the output of the deviation detector for controlling the ignition angle of said controlled semiconductor switching elements, the improvement which comprises:

a first memory device which is connected to the output of said effective value detecting means for storing the effective value of the load current $I_{90}$ at an ignition angle of 90°, a second memory device responsive to the power factor $\phi$ of the load for producing data $$\frac{\Delta I/\Delta\alpha}{I_{90}}$$

where $\Delta I$ represents an increment of the load current and $\Delta\alpha$ an increment of the ignition angle $\alpha$, an operational circuit responsive to the outputs of said deviation detector and of said first and second memory circuits for calculating the value of $\Delta\alpha$ according to an equation $$\Delta\alpha = \frac{\text{current deviation} \times K}{I_{90} \times (\Delta I/\Delta\alpha)/I_{90}}$$

where K represents a gain constant smaller than 1, and an adder which adds $\Delta\alpha$ thus calculated to an ignition angle $\alpha_1$ in a preceding half cycle to determine a new ignition angle $\alpha_2$ and is connected to apply the new ignition angle $\alpha_2$ to said ignition angle control means.

3. The control system according to claim 2 which further comprises a third memory device which stores a current lagging angle of the load at an ignition angle 90° and a fourth memory device connected between the output of said third memory device and the input of said second memory device for producing an output corresponding to the power factor of said load.

4. In a system of controlling the effective value of alternating current supplied to a load from a source of alternating current through controlled semiconductor switching elements which are connected in parallel opposition, the system comprising a reference current setter, means for detecting the effective value of the load current, a deviation detector which detects the difference between the output of said reference current setter and the output of said means for detecting the effective value, and means responsive to the output of the deviation detector for controlling the ignition angle of said controlled semiconductor switching elements, the improvement which comprises:

a first memory device which is connected to the output of said effective value detecting means for storing the effective value of the load current $I_{90}$ at an ignition angle of 90°, a second memory device responsive to the ignition angle $\alpha$ of the switching elements for producing data $$\frac{\Delta I/\Delta\alpha}{I_{90}}$$

where $\Delta I$ represents an increment of the load current and $\Delta\alpha$ an increment of the ignition angle $\alpha$, an operational circuit responsive to the outputs of said deviation detector and of said first and second memory circuits for calculating the value of $\Delta\alpha$ according to an equation $$\Delta\alpha = \frac{\text{current deviation} \times K}{I_{90} \times (\Delta I/\Delta\alpha)/I_{90}}$$

where K represents a constant smaller than 1, and an adder which adds $\Delta\alpha$ thus calculated to an ignition angle $\alpha_1$ in a preceding half cycle to determine a new ignition angle $\alpha_2$ and is connected to apply the new ignition angle $\alpha_2$ to said ignition control means.

5. The control system according to claim 4 which comprises a further memory device connected between the output of said adder and the input of said second memory device.

* * * * *